United States Patent [19]

Cass

[11] 4,038,707

[45] Aug. 2, 1977

[54] FLUSH CONTROLLER

[76] Inventor: Earl T. Cass, 3560 Via Gala, Lompoc, Calif. 93436

[21] Appl. No.: 721,225

[22] Filed: Sept. 8, 1976

[51] Int. Cl.[2] ..... E03D 1/34; E03D 5/02; A61B 19/00

[52] U.S. Cl. ..... 4/67 R; 4/34; 4/67 A; 4/249

[58] Field of Search ..... 4/67 R, 67 A, 34, 37, 4/249, 57 R

[56] References Cited

U.S. PATENT DOCUMENTS

| | | | |
|---|---|---|---|
| 3,156,930 | 11/1964 | Moulton et al. | 4/67 R |
| 3,234,566 | 2/1966 | Rupp | 4/67 R |
| 3,561,015 | 2/1971 | Moore | 4/67 R |
| 3,744,064 | 7/1973 | Preston | 4/34 |
| 3,745,591 | 7/1973 | Girten | 4/67 A |
| 3,777,316 | 12/1973 | Coetzee | 4/34 |

*Primary Examiner*—Henry K. Artis

[57] ABSTRACT

A controller for arbitrarily determining the amount of water from a tank which passes into a toilet bowl makes use of a stop for the flushing handle in one handle position for holding the flexible valve at a location lifted from the tank outlet such that water can flow from the tank but which when released will immediately close the outlet. The handle however is shiftable to a second handle position wherein the flexible valve is lifted to full flush position in which the entire contents of the tank is discharged.

3 Claims, 8 Drawing Figures

FLUSH CONTROLLER

A conventional reservoir or tank for flushing a toilet bowl is designed to hold approximately 5 gallons of water and the mechanism is such that the entire 5 gallons is used every time the bowl is flushed. The water automatically drains from the tank to the bowl and subsequently to the sewer. On a great many occasions the full 5 gallon flush is more than twice the amount necessary to cleanse the bowl and replace its residual water.

In the interest of conserving water so that water be not intentionally wasted, it is desirable to have control of the flushing operation so that enough water and no more, is used to thoroughly cleanse the bowl.

Sundry expedients have been undertaken heretofore in the interest of providing a partial flush for toilet bowls of this kind. Most of these have been so arranged that a fixed amount of partial flush water is used each time and hence each partial flush may or may not be the right amount to cleanse the bowl on those occasions where a complete flush is necessary. It is moreover always essential that the partial flush mechanism not be of such character that it interferes with a full flush whenever that might be needed.

Further still inasmuch as there are virtually millions of flush tanks already in service it is highly desirable to have a controlled flush of such construction that it be readily used with existing equipment with an absolute amount of alteration.

It is therefore among the objects of the invention to provide a new and improved controlled flush for a toilet bowl whereby the operator has complete control over partial flushing conditions as well as having the alternative to employ a full flush on any occasion.

Another object of the invention is to provide a new and improved controlled flush mechanism which makes use of substantially all of the standard mechanism initially installed in the flush tank changed only sufficiently to provide a voluntary partial flush while at the same time not inhibiting a full flush whenever that might be necessary.

Still another object of the invention is to provide a new and improved controlled flush for toilet bowl the mechanism of which makes use of the conventional handle on the tank which is used for flushing purposes, with a minimum of change.

Still another object of the invention is to provide a new and improved mechanism for a controlled flush for toilet bowls wherein those mechanical expedients needed for implementing a partial flush are either concealed within the tank or made such part of the handle that the installation will not detract from the conventional appearance and operation.

Still further among the objects of the invention is to provide a new and improved controlled flush for the toilet bowl of such construction as to be useable in conjunction with a conventional handle wherein flushing operation is obvious to virtually every user whether employing the controlled partial flush or readjusting the operation for a full flush.

With these and other objects in view, the invention consists of the construction, arrangement, and combination of the various parts of the device, whereby the objects contemplated are attained, as hereinafter set forth, pointed out in the appended claims and illustrated in the accompanying drawings.

Figure 1:
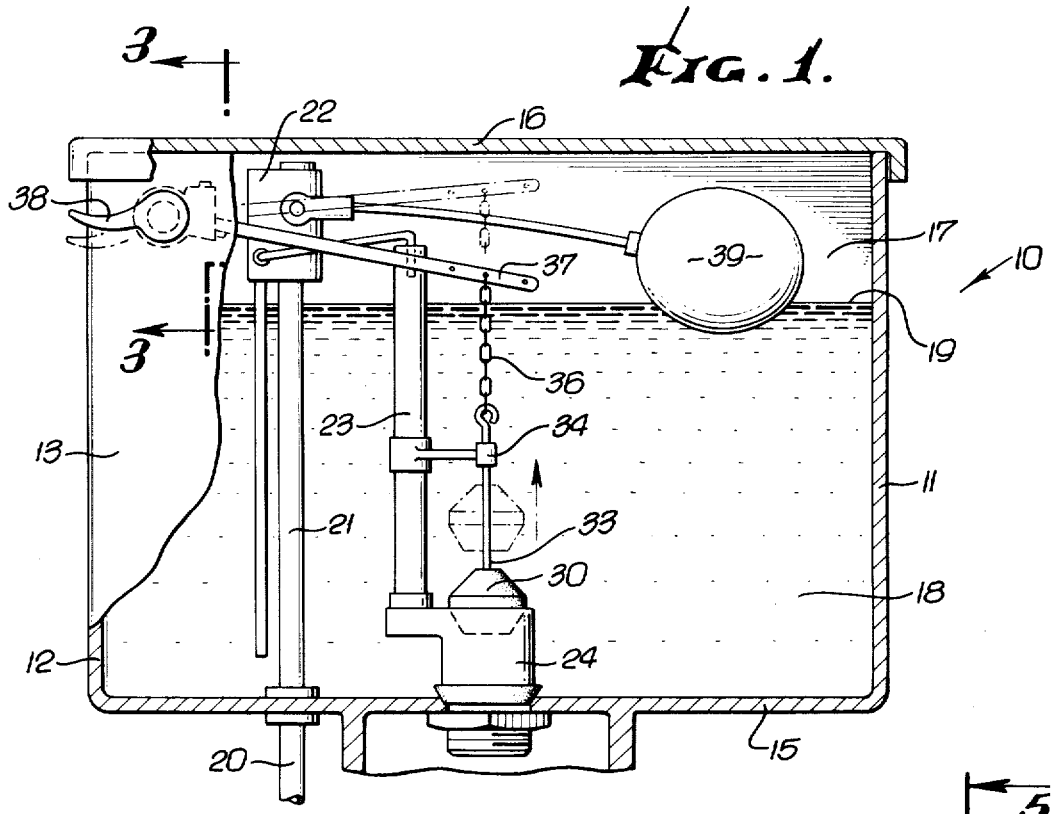
FIG. 1 is a vertical sectional view of a conventional flush tank equipped with one form of the invention.

In one embodiment of the invention chosen for the purpose of illustration, there is shown a toilet water flush tank indicated generally by the reference character 10 consisting of end walls 11 and 12, side walls 13, a bottom 15, and a cover 16 enclosing a chamber 17. The chamber provides for a reservoir 18 of water which when full reaches a level 19.

Figure 2:
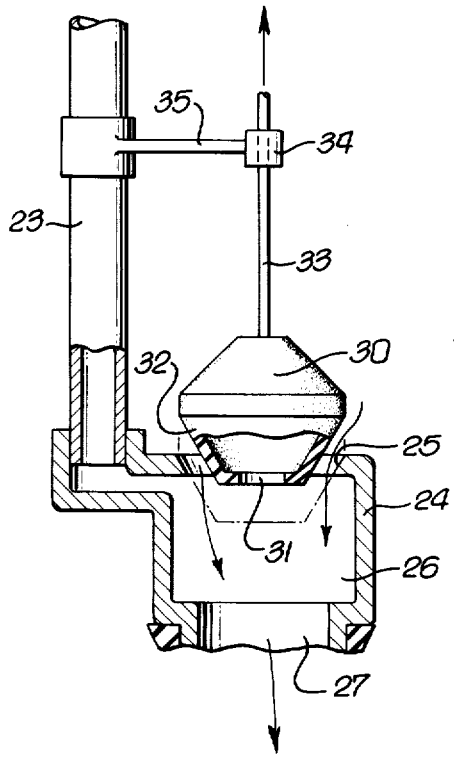
FIG. 2 is a side elevational view of the discharge valve seat and valve, partially broken away, showing the controlled flush position.

An inflow pipe 20 provides water for the reservoir, flowing up through a pipe 21 to a control head 22 housing a conventional refill valve (not shown). An overflow stand pipe 23 communicates between the upper portion of the tank and a fitting 24 on the downstream side of a discharge valve seat 25, is shown in FIG. 2. A pocket 26 into which the discharge valve seat 25 opens feeds a discharge passageway 27 which leads to a conventional toilet bowl (not shown).

For opening and closing the discharge valve seat thereby to empty the contents of the tank 10 into the toilet bowl for flushing purposes there is provided a flexible rubber-like valve element 30 which is hollow and at the lower end of which is an opening 31. A sloping side wall 32 is adapted to contact the complementary wall of the valve seat 25.

A rod 33 on the valve element 30 is guided by sliding through a bushing 34 on a bracket 35 which is fastened to the overflow stand pipe 23. A chain 36 extends upward from the rod 33 and is attached to an arm 37 manipulated by a handle 38, in a substantially conventional fashion. The usual float 39 follows the level 19 of water up and down to alternately turn the control head 22 on and off.

Figure 3:
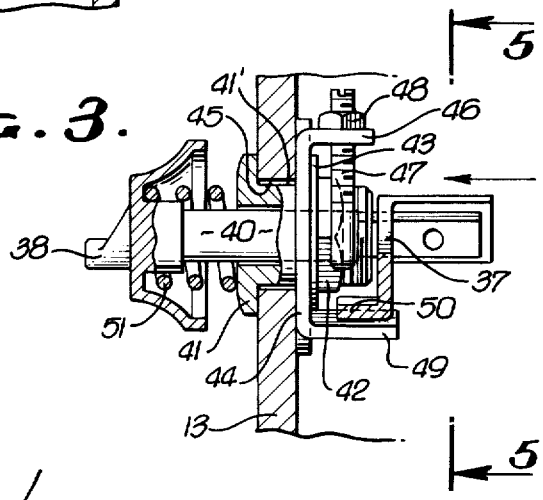
FIG. 3 is a fragmentary vertical sectional view on the line 3 — 3 of FIG. 1, showing the parts in controlled flush position.
Figure 4:
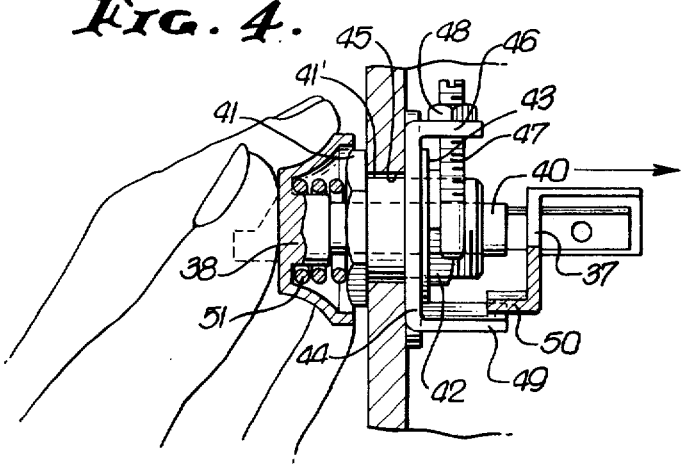
FIG. 4 is a fragmentary vertical sectional view similar to FIG. 3 showing the parts in full flush position.
Figure 5:
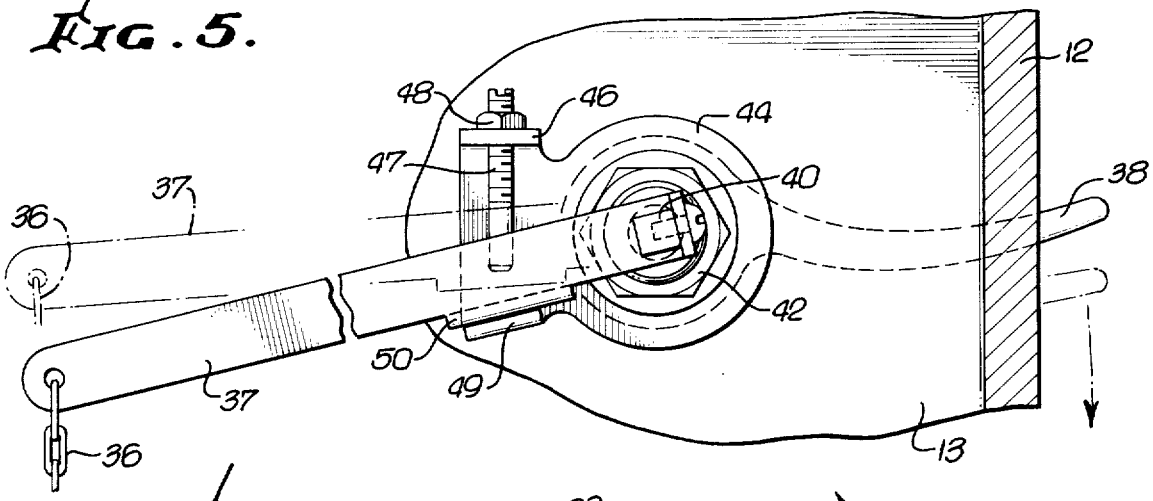
FIG. 5 is a fragmentary elevational view on the line 5 — 5 of FIG. 3.

On the handle 38 is a pivot shaft 40 which is rotatably mounted in a bushing 41 in the side wall 13 of the tank as shown in FIGS. 3, 4, and 5. The bushing has a square exterior 41' fitting in a square hole 45 in the wall 13, anchored by means of a nut 42 and the nut secures beneath it a washer 43 and a bracket 44. The bracket is of special construction in that it has an upper lug 46 in which is threadably mounted a stop pin 47 locked in its selected position of adjustment by means of a lock nut 48. A lower lug 49 has a location spaced from the upper leg 46 and also from the lower end of the stop pin 47.

On the arm 37 is a foot 50 which, in the normal position illustrated in FIG. 3 is located beneath the stop pin 47. A spring 51 normally biases the handle 38 to the normal position of FIG. 3.

In the normal position the parts of the apparatus are set for a controlled flush. This is accomplished by reason of the fact that when the handle 38 is rotated, counterclockwise as viewed in FIG. 1, the foot 50 is stopped against the lower end of the stop pin 47 which is only a small fraction of the full rotation of the handle 38 and only a partial lift of the valve element 30. This means that the valve element 30 is lifted only to the position of FIG. 2 clearing the discharge valve seat 25 but remaining in the path or vortex of outgoing water from the reservoir 18 into the pocket 26 and discharge passageway 27. As long as the operator holds the handle 38 pressed water will flow out of the tank and ultimately into the bowl for flushing purposes. When for example only a partial tank load is adequate for flushing, as for liquids alone, the operator merely releases the handle after what he considers a sufficient flush and the valve element 30 then immediately reseats itself on the valve seat 25 shutting off further flow of water.

To use the handle 38 for a full conventional flush thereby to discharge all of the water from the tank, the handle 38 is pushed axially against tension in the spring 51 in a direction from left to right namely from the position of FIG. 3 to the position of FIG. 4. The accompanying shift in position of the arm 37 and foot 50 removes the foot from a position in line with the stop pin 47 and accordingly, when the handle 38 is rotated in counterclockwise direction the arm 37 is lifted through its full range of movement from the solid line position of FIG. 1 to the broken line position of FIG. 1, instead of the limited range of movement first described when the arm was stopped against the stop pin 47. When this occurs the valve element 30 is lifted up out of the vortex caused by water rushing past the valve seat 25, where it is held by hydraulic action until the tank is empty, even though the operator releases the handle 38. When the handle is released the foot 50 engages the lower lug 49 which limits downward movement of the arm 37 in the usual fashion. This limiting of return movement by the lug 49 occurs in both positions of the handle 38 and the arm 37. As promptly as the operator releases the handle 38 the spring 51 returns it in a direction from right to left as viewed in FIG. 4 from the position of FIG. 4 to the position of FIG. 3.

The threaded engagement of the stop pin 47 with the upper lug 46 is for the purpose of an initial adjustment of the position of the valve element 30 so that it far enough removed from the seat 25 to allow an adequate flow of water for controlled flushing but still not so far but what it will remain under the influence of the outflow of water whereby to promptly reseat.

Figure 6:
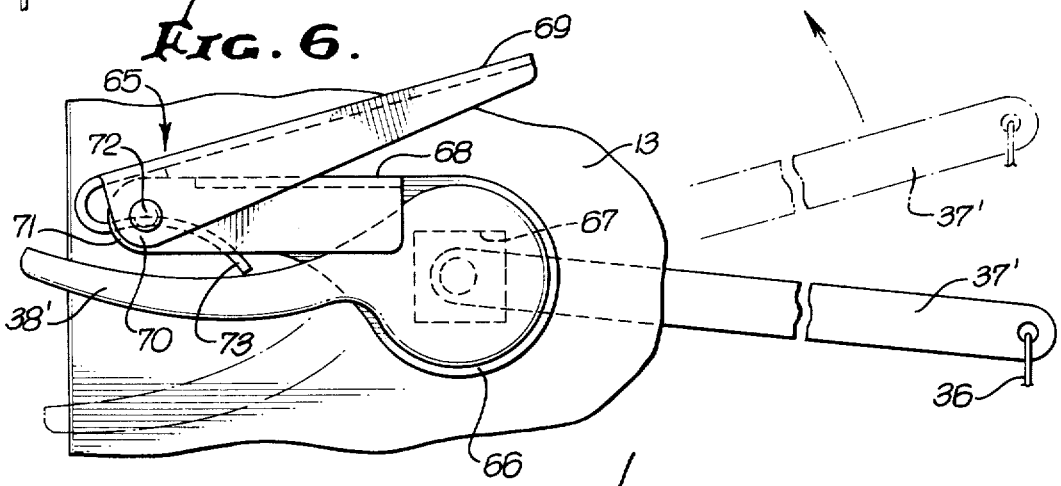
FIG. 6 is a front elevational view of a second form of the invention.
Figure 8:
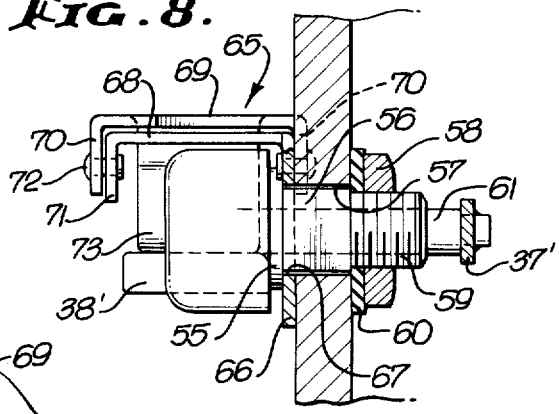
FIG. 8 is a vertical sectional view on the line 8 — 8 of FIG. 7.
Figure 7:
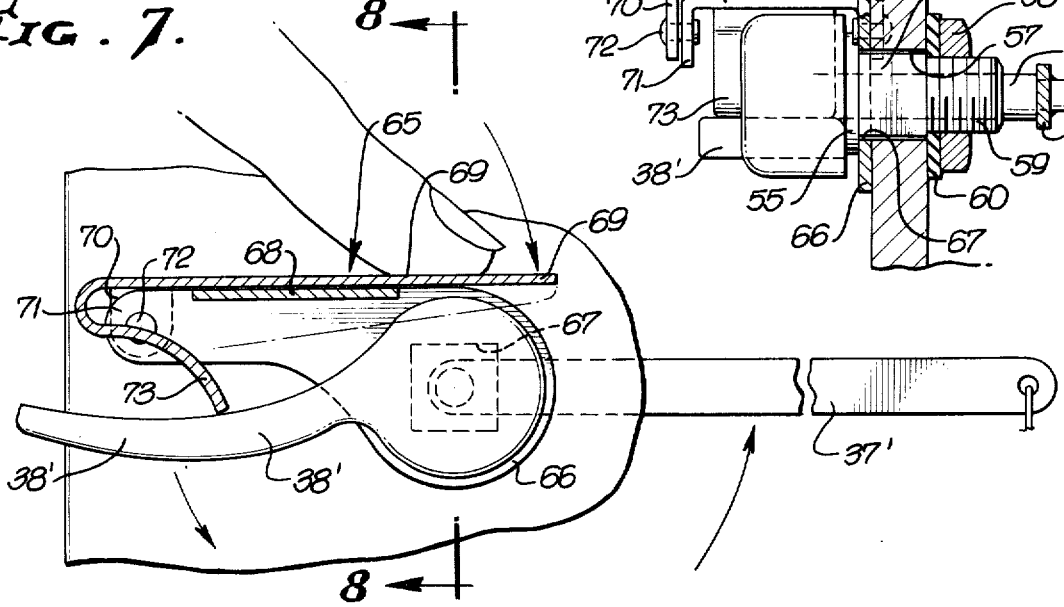
FIG. 7 is a side elevational view partially broken away showing the form of invention of FIG. 6 in controlled flush position.

In the form of invention of FIGS. 6, 7, and 8 the same result is achieved but by a stop mechanism slightly different from that of FIGS. 1 through 5 inclusive. In this form of device a bushing 55 has a shank 56 which, like the shank of the bushing 41, is square and fits nonrotatably in a square hole 57 of the tank wall 13. A nut 58 on a threaded end 59 of the shank is drawn against a sealing washer 60 to hold the bushing in position. On the handle 38′ is a pivot shaft 61 to which an arm 37′ is nonrotatably attached. Rotation of the handle relative to the bushing is limited in the usual conventional manner, namely between a position wherein the valve element 30 is seated to a position wherein the valve element is lifted to allow full discharge of the tank.

For a controlled discharge use is made of a fixture indicated generally by the reference character 65. The fixture includes a flat portion 66 in which is a square hole 67 which fits over the square shank 56 of the handle 38′. Hence the fixture cannot rotate relative to the bushing. Fixed to the flat portion is a platform 68 serving as a stop. An auxiliary lever 69 has ears 70 pivotally mounted on ears 71 of the flat portion by means of pivot pins 72. On the fixture 65 is a stop arm 73 which extends downwardly as viewed in FIGS. 6 and 8 into engagement with the handle 38′. Normally, return action of the valve element 30 pulling on the arm 37′ rotates the handle 38′ clockwise to initial position and this motion is translated to the stop arm 73 whereby to lift the auxialliary lever 69 to the position of FIG. 6.

To give the tank a partial or controlled flush the operator merely depresses the auxiliary lever 69 for the limit of its range of movement namely from the position of FIG. 6 to the position of FIG. 7. In the latter position further movement is stopped by engagement of the auxialliary lever 69 with the platform 68. This is a range of movement sufficient only to lift the valve element 30 to the solid line position of FIG. 2 which is the controlled position similar to that achieved by movement of the arm 37 of FIGS. 1 through 5 inclusive to its position against the stop pin 47. As long as the auxialiary lever 69 is held in this depressed position water will flow from the tank for flushing purposes, and will stop as promptly as the auxiliary lever is released.

For a full flush action the operator merely depresses the handle 38′ in a conventional way shifting it counterclockwise as viewed in FIGS. 6 and 7, for the full range of its movement which is the conventional movement for a full flush action. During this movement the handle 38′ merely moves away from the stop arm 73, being capable of returning to that position merely by release of the handle in the usual fashion.

Having described this invention what is claimed in support of Letters Patent is as follows:

1. A controller for use on a toilet water flush tank which includes a discharge valve seat at the bottom of the tank,
   a flexible discharge valve element,
   and a handle pivotally mounted on a tank having a lifting lever connected to the discharge valve element by means of a flexible tie,
   said controller comprising
   a stop on the tank having a position of engagement with said handle,
   the engagement of the stop with the handle being at a first handle position wherein the handle is limited to a first range of movement in which the discharge valve is lifted from the discharge valve seat a distance sufficient to permit outflow of water from the tank but insufficient to allow full discharge of the tank,
   said handle having a second range of movement out of the influence of said stop wherein at the end of said second range of movement the handle is at a second position and the discharge valve is at a distance from the discharge valve seat sufficient to allow full discharge of the tank,
   said stop comprising an auxiliary fixture including a portion having a nonrotatable mounting on said tank at a location adjacent said handle,
   said auxiliary fixture comprising a lever pivotally mounted on the fixture,
   a first arm on said lever adapted to engage said handle at a movable portion of said handle,
   a stationary shoulder mounted on the tank and a second lever on said fixture having a position of engagement with said shoulder wherein the handle is moved to said first handle position.

2. A controller as in claim 1 wherein the auxiliary fixture is on the exterior of said tank.

3. A controller as in claim 1 wherein the shoulder is part of said auxiliary fixture.

* * * * *